US005110139A

United States Patent [19]

Baumgartner

[11] Patent Number: 5,110,139

[45] Date of Patent: May 5, 1992

[54] DISK TOSS GAME

[76] Inventor: William A. Baumgartner, 2398 York St., E. Meadow, N.Y. 11554

[21] Appl. No.: 737,154

[22] Filed: Jul. 29, 1991

[51] Int. Cl.[5] ..... A63B 67/06
[52] U.S. Cl. ..... 273/400
[58] Field of Search ..... 273/400, 401, 402

[56] References Cited

U.S. PATENT DOCUMENTS 2,126,245 8/1938 Darby ..... 273/400 X
4,392,653 7/1983 Blume, Sr. ..... 273/400
4,877,256 10/1989 Falloon ..... 273/400
4,982,966 1/1991 Teafatiller ..... 273/400 X

*Primary Examiner*—William H. Grieb
*Attorney, Agent, or Firm*—Richard L. Miller

[57] ABSTRACT

A disk toss game is provided and consists of a plurality of game pieces that are tossed at a receptacle that is placed onto a playing surface at a predetermined distance away from a player. The game pieces will land into a first central target area, into a second larger target area and proximate the receptacle to indicate different points received by the player during the play of the game.

7 Claims, 1 Drawing Sheet

DISK TOSS GAME

BACKGROUND OF THE INVENTION

The instant invention relates generally to tossing games and more specifically it relates to a disk toss game.

Numerous tossing games have been provided in the prior art that are adapted to utilize objects which are pitched at a target area so that points are scored after the objects have landed. For example, U.S. Pat. Nos. 2,126,245 to Darb 4,203,592 to Quatkemeyer and 4,204,682 to Brown all are illustrative of such prior art. While these units may be suitable for the particular purpose to which they address, they would not be as suitable for the purpose of the present invention as hereafter described.

SUMMARY OF THE INVENTION

A primary object of the present invention is to provide a disk toss game that will overcome the shortcomings of the prior art devices.

Another object is to provide a disk toss game that can be played on virtually all types of surfaces, including indoors and outdoors with no damage caused to the lawn.

An additional object is to provide a disk toss game that is portable, storable and safe to use.

A further object is to provide a disk toss game that is simple and easy to use.

A still further object is to provide a disk toss game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
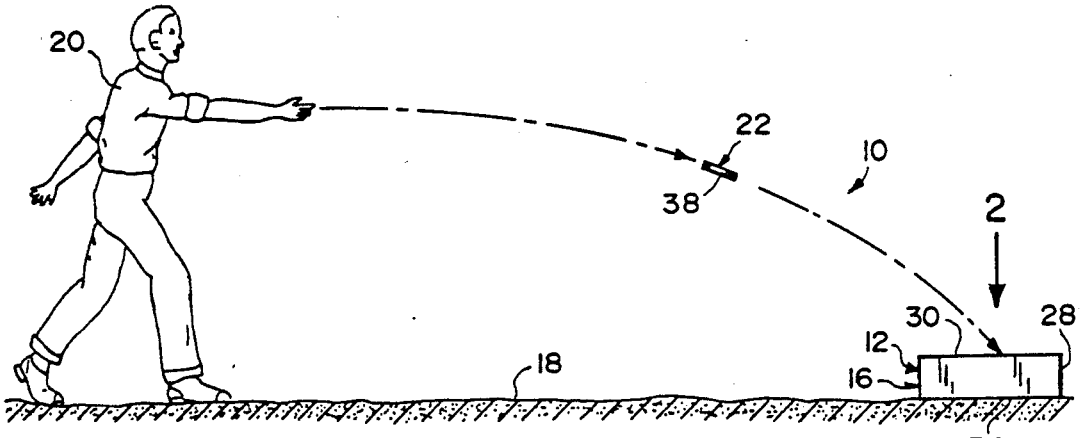
FIG. 1 is a diagrammatic perspective view illustrating the instant invention in use.
Figure 2:
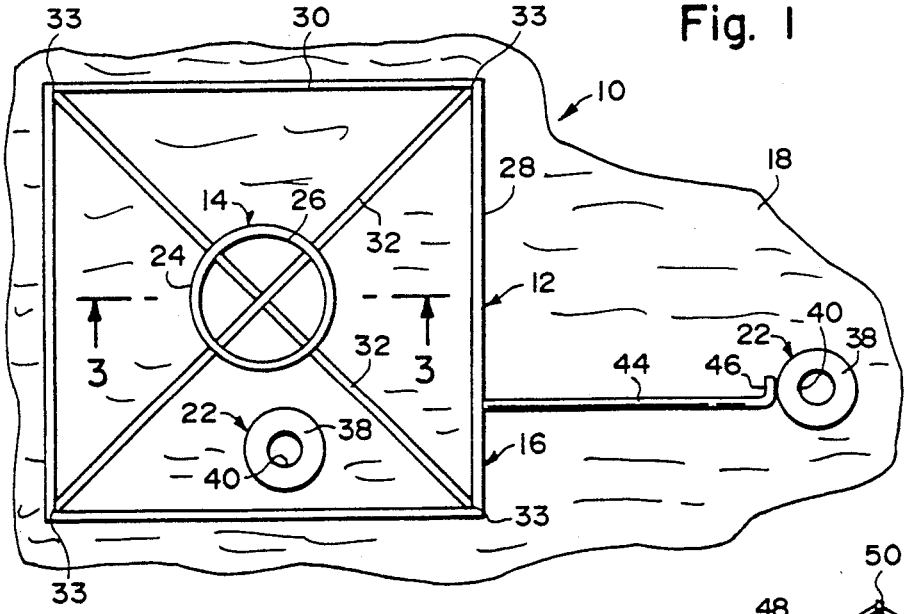
FIG. 2 is an enlarged top plan view of a first embodiment taken in the direction of arrow 2 in FIG. 1 showing the use of a rod to measure distance between game pieces.
Figure 3:
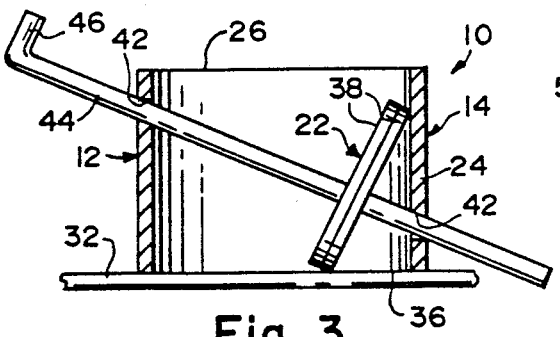
FIG. 3 is a cross sectional view with parts broken away taken along line 3—3 in FIG. 2 showing the rod used as a holding mechanism for the disks when the game is not being used.

Turning now descriptively to the drawings, in which like reference characters denote like elements throughout the several views, FIGS. 1 through 3 illustrate a disk toss game 10 consisting of a receptacle 12 having a first central target area 14 and a second larger target area 16 about the first target area 14. The receptacle 12 is placed onto a playing surface 18 at a predetermined distance away from a player 20. A plurality of game pieces 22 are tossed at the receptacle 12 by the player 20. The game pieces 22 may land into the first central target area 14, into the second larger target area 16 and outside but proximate the entire receptacle 12 to indicate different points the player 20 will receive during the play of the game 10.

The first central target area 14 of the receptacle 12 is a hollow, cylindrical member 24 having an open top end 26 to receive the game pieces 22 tossed thereto. The second larger target area 16 of the receptacle is a box member 28 having an open top end 30 to receive the game pieces 22 tossed thereto. A pair of bars 32 are affixed to the corners 33 of the open bottom 34 of the box member 20 in an X-shaped configuration so that the open bottom end 36 of the hollow cylindrical member 24 can be secured thereto.

Each game piece 22 is a annular disk 38 having a central aperture 40 therethrough. The hollow cylindrical member 24 has a pair of oppositely angularly positioned holes 42 therethrough. An elongated rod 44 is provided having a right angle bent end 46. In one instance, as shown in FIG. 3, the rod 44 can extend through the holes 42 in the hollow cylindrical member 24 and the apertures 40 in the annular disks 38 when the game 10 is not being used. In another instance, as shown in FIG. 2, the rod 44 can be used to measure the distance between each annular disk 38 and the box member 28 when proximate to the receptacle 12.

Figure 4:
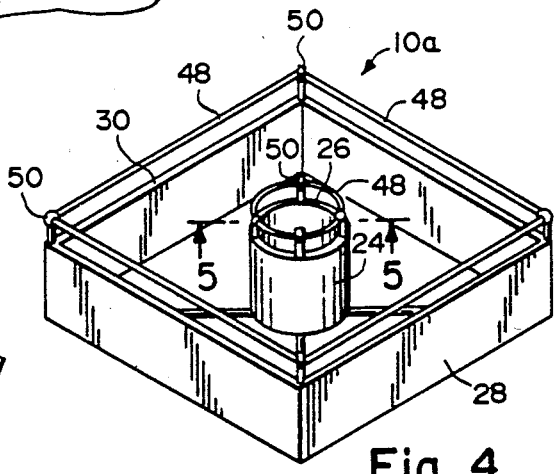
FIG. 4 is a perspective view of a second embodiment of the instant invention.
Figure 5:
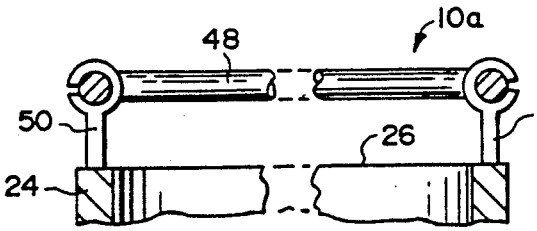
FIG. 5 is an enlarged cross sectional view taken along Line 5—5 in FIG. 4 with parts broken away showing the construction thereof in great detail.

A second embodiment 10*a* is shown in FIGS. 4 and 5 in which bumper rails 48 are supported by stanchions 50 above the open top ends 26 and 30 of the hollow cylindrical member 24 and the box member 28 so as to help deflect the tossed annular disks 38 therefrom to enhance the play of the game 10*a*.

In the first embodiment illustrated in FIGS. 2 and 3 the entire disk toss game 10 can be fabricated out of metal, typically steel, so that when a annular disks 38 strikes the device a loud resounding ringing noise is created adding to the players excitement and also signifying to all in attendance that a hit has been scored. In the second embodiment illustrated in FIGS. 4 and 5 most of the disk toss game 10 is fabricated out of plastic and just the rails 48 are fabricated out of metal. This construction reduces both the weight and cost of the device while still retaining significant noise making characteristics.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

APPENDIX

Typical Rules of the Game:

1. Two to four players can play the game.
2. A score of twenty one points wins.
3. The annular disks 38 are two per team, and marked to be distinguishable for each team.
4. The scores are five points for tossing an annular disk 38 into the first central target area 14, three points for tossing an annular disk 38 into the second larger target area 16 and one point for tossing an annular disk 38 proximate the receptacle 12 but within range of the measurement of rod 44.

5. The game must be won by at least two points or the game continues until one team has a two point advantage. For example, if the score is twenty one to twenty the teams must play until the score becomes twenty two to twenty.

6. The predetermined distance between the players and the receptacle 12, for adults should be at least thirty feet or any other comfortable distance decided upon.

What is claimed is:

1. A disk toss game comprising:

a) a receptacle having a first central target area and a second larger target area about the first area whereby said receptacle is placed onto a playing surface at a predetermined distance away from a player, wherein the first central target area of said receptacle is a hollow cylindrical member having an open top end to receive said game pieces tossed thereto, wherein the second larger area of said receptacle is a box member having an open top end to receive said game pieces tossed thereto, wherein said receptacle further including a pair of bars affixed to the corners of the open bottom end of said box member in an X-shaped configuration so that the open bottom end of said hollow cylindrical member can be secured thereto; and b) a plurality of game pieces that are tossed at said receptacle by the player so that said game pieces may land into the first central target area, into the second larger target area and outside but proximate said receptacle to indicate different points the player will receive during the play of said game.

2. A disk toss game as recited in claim 1, wherein each said game piece is a annular disk having a central aperture therethrough.

3. A disk toss game as recited in claim 2, further including:

a) said hollow cylindrical member having a pair of oppositely angularly positioned holes therethrough; and b) an elongated rod having a right angle bent end so that in one instance said rod can extend through the holes in said hollow cylindrical member and the apertures in said annular disks so as to act as a holder for said annular disks when said game is not being used and in another instance said rod can be used to measure the distance between each said annular disk and said box member when proximate to said receptacle.

4. A disk toss game as recited in claim 3, further including metal bumper rails supported by stanchions above the open top ends of said hollow cylindrical member and said box member so as to create a loud resounding ringing noise adding to the players excitement and also signifying to all in attendance that a hit has been scored when the tossed annular disks also fabricated out of metal are deflected therefrom.

5. A disk toss game comprising:

a) a receptacle fabricated out of metal having a first central target area and a second larger target area about the first area whereby said receptacle is placed onto a playing surface at a predetermined distance away from a player, wherein the first central target area of said receptacle is a hollow cylindrical member having an open top end to receive said game pieces tossed thereto, wherein the second larger area of said receptacle is a box member having an open top end to receive said game pieces tossed thereto, wherein said receptacle further including a pair of bars affixed to the corners of the open bottom end of said box member in an X-shaped configuration so that the open bottom end of said hollow cylindrical member can be secured thereto; and b) a plurality of game pieces fabricated out of metal that are tossed at said receptacle by the player so that when said game pieces strike the first central target area or the second larger target area a loud resounding ringing noise is created adding to the players excitement and also signifying to all in attendance that a hit has been scored.

6. A disk toss game as recited in claim 5, wherein each said game piece is a annular disk having a central aperture therethrough.

7. A disk toss game as recited in claim 6, further including:

a) said hollow cylindrical member having a pair of oppositely angularly positioned holes therethrough; and b) an elongated rod having a right angle bent end so that in one instance said rod can extend through the holes in said hollow cylindrical member and the apertures in said annular disks so as to act as a holder for said annular disks when said game is not being used and in another instance said rod can be used to measure the distance between each said annular disk and said box member when proximate to said receptacle.

* * * * *